US006256856B1

(12) United States Patent
Squillacci, Jr. et al.

(10) Patent No.: US 6,256,856 B1
(45) Date of Patent: Jul. 10, 2001

(54) METHOD OF FORMING A FUSION NIB ON A PART

(75) Inventors: Anthony Squillacci, Jr., Johnston; Anthony Squillacci, Sr., Providence, both of RI (US)

(73) Assignee: APAC Tool, Inc., Providence, RI (US)

( * ) Notice: Subject to any disclaimer, the term of this patent is extended or adjusted under 35 U.S.C. 154(b) by 0 days.

(21) Appl. No.: 09/404,770

(22) Filed: Sep. 24, 1999

(51) Int. Cl.[7] ..... B23P 17/00
(52) U.S. Cl. ..... 29/412; 29/896.42
(58) Field of Search ..... 29/10, 412, 417, 29/896.42, 558; 72/379.2, 404

(56) References Cited

U.S. PATENT DOCUMENTS

| | | | | |
|---|---|---|---|---|
| 1,324,807 | | 12/1919 | Gibbs . | |
| 1,566,845 | | 12/1925 | Fairbrother . | |
| 2,059,582 | * | 11/1936 | Hurewitz | 29/896.42 |
| 2,148,672 | * | 2/1939 | Arentzen | 29/558 |
| 3,566,514 | * | 3/1971 | Szumigala | 29/558 |
| 3,795,038 | * | 3/1974 | Brezinski et al. | 29/417 |
| 3,952,574 | * | 4/1976 | Speidel | 72/379 |
| 4,095,490 | * | 6/1978 | Atkinson | 72/379 |
| 4,346,582 | | 8/1982 | Bailey | 72/379 |
| 4,356,719 | | 11/1982 | Sutherland et al. | 72/391 |
| 4,702,100 | | 10/1987 | Levine et al. | 72/406 |
| 5,247,825 | * | 9/1993 | Erickson | 72/379.2 |

* cited by examiner

*Primary Examiner*—S. Thomas Hughes
*Assistant Examiner*—Jermie E. Cozart
(74) *Attorney, Agent, or Firm*—Barlow, Josephs & Holmes, Ltd.

(57) ABSTRACT

An improved method of forming a fusion nib on a part uses a progressive die system. The method utilizes a thin feed strip of rigid, formable material and forms the nib on a side edge of the strip using multiple progressive dies. A first die shears a side edge portion of the strip to define a finger element in the side edge of the strip. A second die is then propelled horizontally into the terminal end of the finger element to form the finger element into a mounting shoulder and a small nib on the center of the mounting shoulder. A third die then blanks out the body portion of the desired piece from the strip in another vertical stamping operation. The desired piece is thus separated from the feed strip with the nib completely formed thereon.

10 Claims, 4 Drawing Sheets

METHOD OF FORMING A FUSION NIB ON A PART

BACKGROUND AND SUMMARY OF THE INVENTION

The instant invention relates to a method of forming a fusion nib on a part in a progressive die system, and more particularly to a method of forming a fusion nib on a stamped backing for a jewelry article.

In many industries, and particularly in the jewelry industry, it has become desirable to attach parts together using a fusion process rather than a soldering process. The fusion process provides a much stronger connection than soldering and is more easily automated than soldering, thus leading to a better quality lower cost product. The advantages of widespread use of such technology are obvious from a business standpoint.

Generally speaking, fusion is accomplished by applying a low voltage, high amperage current between two adjacent parts. The electrical current arcs and welds the parts together using local material from each of the parts as working material. In carrying out these processes, it has been discovered that it is advisable to form a fusion nib, i.e. a small bump or protrusion, on one of the parts to be fused. The nib acts to provide some of the local working material for the weld and may also act as a registration point for aligning a mating part having either a recess or an aperture.

In industries where the fused parts are larger and easy to work with, the fusion nib can be formed by casting methods or other conventional machining methods. However, in the jewelry industry, where the parts are usually small, it has been difficult, if not impossible, to form a fusion nib by conventional casting and machining methods. Accordingly, the widespread use of fusion technology has not yet occurred in the jewelry industry, or in other industries where the working parts are small.

The instant invention provides an improved method of forming a fusion nib on a part using a progressive die system. The method utilizes a thin strip of material as raw material and forms the nib on a side edge of the strip using multiple progressive dies. A first die stamps out a finger in the edge of the strip in a vertical stamping operation. A second die is then propelled horizontally into the terminal end of the finger to flatten the finger into a mounting shoulder and a small nib on the center of the mounting shoulder. A third die then blanks out the desired piece from the strip in another vertical stamping operation. The resulting piece is thus separated from the strip with the nib completely formed thereon.

In the case of the preferred embodiment illustrated herein, the desired part is a J-shaped earring back. The J-shaped back is assembled with a lever to form a completed pierced earring back. In further production, a finding, such as a stone setting, or an ornamental ball, is aligned adjacent to the mounting shoulder and fused together with the mounting shoulder to form a finished earring. For example, the fusion nib is aligned with an ornamental ball, and a current is applied across the aligned pieces. During arcing, the current flows directly through the fusion nib as a path of least resistance to the ball, or vice-versa. The nib instantaneously disintegrates and reforms as a weld between the mounting shoulder and the surface of the ball.

One very important advantage to the present invention is that it is not necessarily limited to the jewelry industry. The same method can also be used to form nibs on other larger parts. Because the method is a progressive stamping method, and uses strip feed material, the process is easily automated and inexpensive.

Accordingly, among the objects of the instant invention are: the provision of a simple and effective method of forming a fusion nib on small parts; the provision of a method of forming a fusion nib comprising the progressive stamping of a strip of feed material; the provision of a method of forming a fusion nib wherein the nib is formed in the side edge of the material using simple stamping dies.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
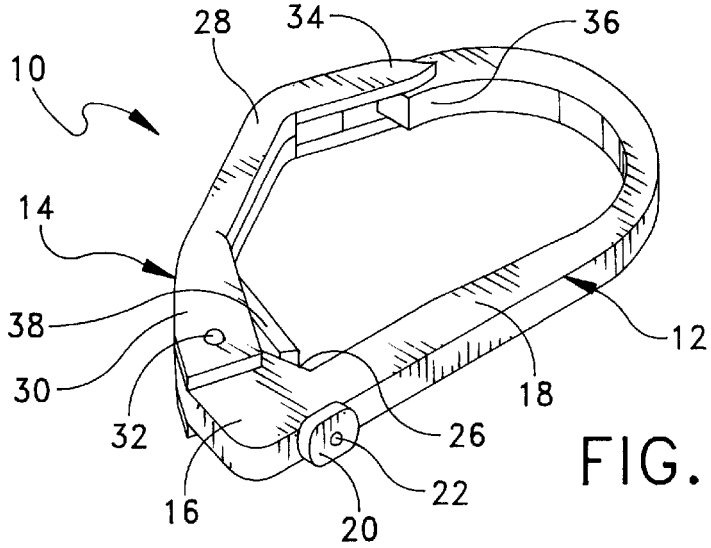
FIG. 1 is a perspective view of a lever back earring having a fusion nib formed on the body thereof.

Referring now to the drawings, the instant invention will be described in connection with the formation of a leverback pierced earring assembly as illustrated and generally indicated at 10 in FIG. 1. As will hereinafter be more fully described, the instant invention preferably uses a progressive die system to form a very small fusion nib on small parts, such as parts that will be used in jewelry items.

The leverback assembly 10 comprises a J-shaped body generally indicated at 12, and an arcuate lever assembly generally indicated at 14.

The J-shaped body includes a base portion 16, and a hook portion 18 depending from the base portion 16. The base portion 16 is formed with a mounting shoulder 20 on the forward side edge thereof and a fusion nib 22 projecting outwardly from the center of the mounting shoulder 20. The base portion 16 further includes an aperture 24 for attachment of the lever 14, and a cam surface 26 for the spring biased lever assembly 14.

The lever assembly 14 comprises a closure arm 28 having a first end 30 pivotably attached to the base portion 16 by a pivot pin 32, and a second end 34 that engages with the terminal end 36 of the hook portion 18 of the body 12 to close the opening of the J-shaped body, thus forming a closed pierced earring assembly 10. The lever assembly 14 further comprises a spring arm 38 that is captured within the closure arm 28 and engages with the cam surface 26 of the base portion 16 to provide bias for maintaining the closure arm 28 in closed and open positions. The general operation of the leverback construction 10 is well known in the art and therefore further description thereof is not believed to be necessary.

Turning now to the method of forming the J-shaped body 12 and the fusion nib 22, there is shown in FIGS. 2–6 a series of stamping and forming steps using a progressive die system. More specifically, the method utilizes a thin feed strip 40 of rigid, formable metal as working material. The metal can comprise any type of metal which is desirable for use in jewelry articles, and earrings, such as gold, silver, stainless steel, etc. It is to be understood that the type of metal is not critical to carrying out the method of the invention, and this disclosure is not intended to be limited by the metals described herein. The metal can also be provided in a sheet form if desired. However, in connection with a preferred method of use in a progressive die system, the metal is preferably provided as elongated strip 40. The thickness of the feed strip is also not critical to operation of the method, although there are practical minimum and maximum limits to the thickness of the strip. Typically, for use in the present application, i.e. a pierced earring, the thickness of the strip 40 could be in the range of about 0.1 mm to about 1.0 mm.

In the general process, the feed strip 40 is trained into a progressive die system having a plurality of operating stations driven by a single press. With each cycle of the press, the feed strip 40 is advanced through the operating stations of the die system. Each station includes a pair of metal forming tools which will be described hereinafter. In the use of progressive die systems, it is necessary to provide index openings 42 in the feed strip 40 to allow indexing of the feed strip 40 through the different dies. The index openings 42 can be provided by the manufacturer of the strip or can be formed as an initial step of the progressive methods as described herein.

Figure 2:
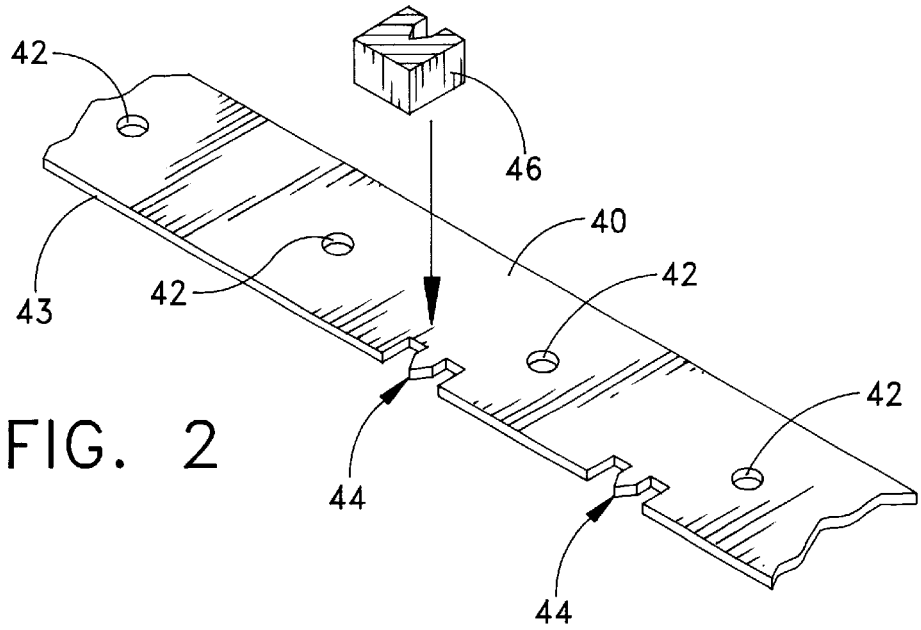
FIG. 2 is a perspective view of the feed material and the first die that forms the finger in the side edge of the material.
Figure 3:
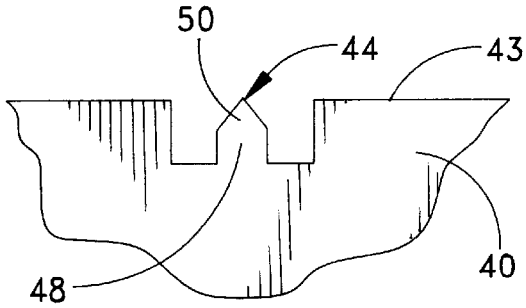
FIG. 3 is an enlarged plan view of the finger.

Still referring to FIGS. 2 and 3, the first step is to remove a portion of the side edge 43 of the strip 40 to define a finger generally indicated at 44 that extends perpendicularly outwardly from the strip 40 transverse to the longitudinal extent of the strip. Preferably, the material is removed using a first stamping die 46 that shears the material from the side edge 43 of the strip 40 in a vertical stamping operation. The die 46 cooperates with a complementary support (not shown) for carrying out of the shearing operation. The finger 44 is preferably dart-shaped having a linear body portion 48 and a pointed head portion 50. However, the body portion 48 and head portion 50 could otherwise have different geometric shapes depending on the final form and size of the mounting shoulder 20 and fusion nib 22.

Figure 4:
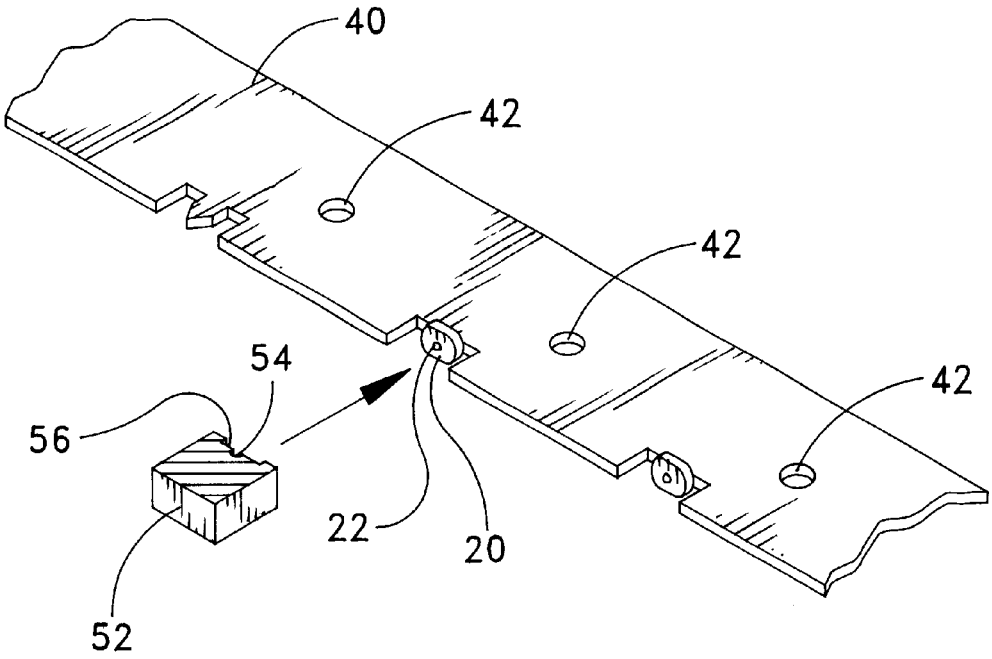
FIG. 4 is another perspective view of the feed material and the second die that forms the mounting shoulder and the nib from the finger.
Figure 5:
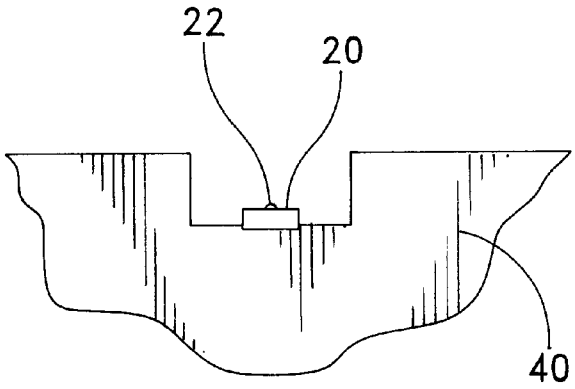
FIG. 5 is an enlarged plan view of the mounting shoulder and fusion nib.

Referring to FIGS. 4 and 5, the second step is to form, or compress, the finger element 44 into the mounting shoulder 20 and fusion nib 22. Preferably, this is accomplished with a second die 52 that is propelled horizontally into the head portion 50 of the finger 44 to flatten the finger 44 into the mounting shoulder 20 and nib 22. The die 52 has a center nib forming recess 54 and a peripheral shoulder forming recess 56. However, the shape of the die 52 could vary depending on the size of the nib 22, size of the shoulder 20, shape of the shoulder etc. Clamps and index pin s (not shown) hold the feed strip 40 in place while the die 52 is driven into the finger element 44.

Figure 6:
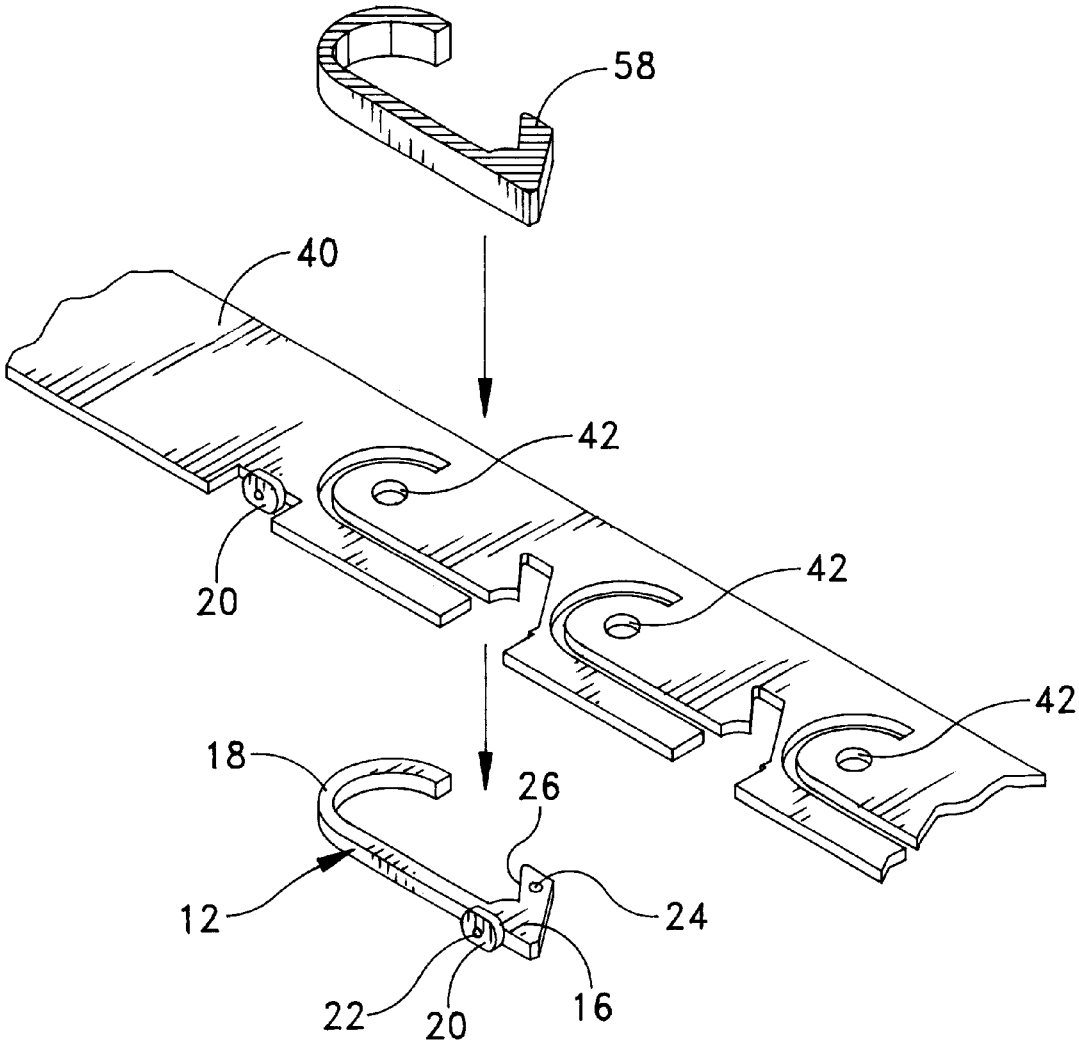
FIG. 6 is yet another perspective view of the feed material and the third die that stamps the body of the part from the feed material.

Referring to FIG. 6, the third and final step is to remove the desired part 12 from the strip 40 wherein the part 12 includes the now formed mounting shoulder 20 and nib 22. This is accomplished with a third die 58 in a vertical stamping operation. The die 58 is in the shape of the desired part and cooperates with a corresponding support tool (not shown) to separate the finished part from the strip 40 with the shoulder 20 and nib 22 completely formed thereon. In the case of the preferred embodiment illustrated herein, the desired part 12 is a J-shaped earring back, and thus the die 58 is generally in the form of the J-shaped body. To provide the pivot opening 24 for mounting of the lever assembly 14, the aperture 24 is punched in the 12 desired location in the feed strip 40 just prior to removal of the part 12 from the strip 40.

Figure 7:
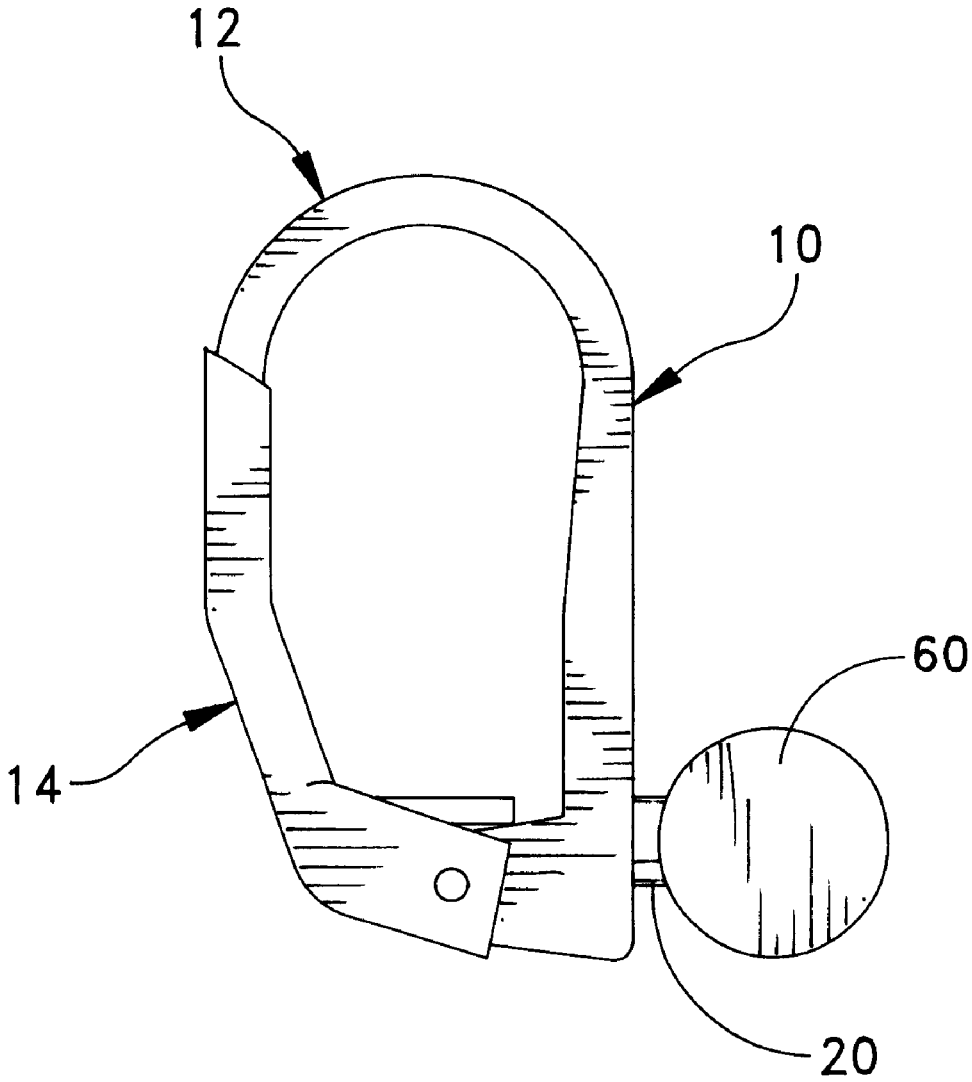
FIG. 7 is a side view showing fusion of the earring back with a decorative ornament.

Referring to FIG. 7, the J-shaped body 12 is then assembled with a lever assembly 14 in a conventional manner to form the completed pierced earring back 10. In further production, a finding, such as a stone setting, or for example, an ornamental ball 60, is aligned adjacent to the mounting shoulder 20 and fused together with the mounting shoulder 20 to form a finished earring. More specifically, the fusion nib 22 is aligned with an ornamental ball 60 in a welding device (not show n), and a current is applied across the aligned pieces 10, 60. During arcing, the current flows directly through the fusion nib 22 as a path of least resistance to the ball 60, or vice-versa. The nib 22 instantaneously disintegrates and reforms as a weld between the mounting shoulder 20 and the surface of the ball 60. The welded part can then be further finished according to the desires of the end retailer or wholesaler.

One very important advantage to the present invention is that it is not necessarily limited to the jewelry industry. The same method can also be used to form nibs on other small parts that are to be welded, and can further be used on larger parts. Because the method is a progressive die forming method, and uses strip feed material, the process is easily automated and once set up, inexpensive to run for many pieces.

While the above-noted methodology is specifically described as utilizing a progressive die forming method, it should be understood that this type of manufacturing is referenced as a preferred method of manufacturing. Other forming methods involving separate steps are equally possible within the scope of the invention, the crux of the invention being the formation of a finger element on the edge of a part, and then the formation of the finger element into a shoulder and nib. For example, an alternative method would comprise the steps of removing the desired part from the sheet with the finger element attached, and then forming the finger element into the shoulder and nib in another separate step. In this regard, the finger element could be formed first and then the part removed from the sheet, or the part including the finger element could be removed from the sheet in a single blanking operation.

It can therefore be seen that the instant invention provides a simple and effective method of forming a fusion nib on a part, and in particular a small jewelry part. The use of progressive stamping and forming dies to form the nib on a strip of feed material is considered to be a significant improvement in the art which will lower the cost of manufacturing and provide a higher quality end product. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of forming a fusion nib on a part comprising the following steps:

providing a sheet of substantially rigid, formable material;

shearing an edge portion of said sheet to define a finger element on said edge portion;

forming said finger element into a shoulder by striking a terminal end of said finger element with a forming die, wherein the finger element is flattened into a shoulder portion and a fusion nib portion, said fusion nib extending outwardly from said shoulder; and removing a completed part from said sheet wherein said part includes said shoulder having said fusion nib.

2. The method of claim 1 wherein said finger element is formed in the shape of a dart having a body portion and a pointed head portion.

3. The method of claim 2 wherein said finger element extends perpendicular to a longitudinal extent of the sheet.

4. The method of claim 1 wherein said step of removing said part from said sheet comprises the step of stamping said part from the sheet of material wherein said part includes said shoulder and said fusion nib.

5. A method of forming parts having a fusion nib comprising the following steps, performed in succession at the operating stations of a progressive die system:

providing an elongated feed strip of substantially rigid, formable material;

shearing an edge portion of said feed strip to define a finger element on said edge portion of said feed strip;

forming said finger element into a shoulder by striking a terminal end of said finger element with a forming die, wherein the finger element is flattened into a shoulder portion and a fusion nib portion, said fusion nib extending outwardly from said shoulder; and removing a completed part from said sheet wherein said part includes said shoulder having said fusion nib.

6. The method of claim 5 wherein said finger element is formed in the shape of a dart having a body portion and a pointed head portion.

7. The method of claim 6 wherein said finger element extends perpendicular to a longitudinal extent of the feed strip.

8. The method of claim 5 wherein said step of removing said part from said feed strip comprises the step of stamping said part from the feed strip wherein said part includes said shoulder and said fusion nib.

9. A method of forming a fusion nib comprising the following steps:

providing a substantially rigid, formable material;

defining a finger element on an edge portion of said material; and forming said finger element into a shoulder by striking a terminal end of said finger element with a forming die, wherein the finger element is flattened into a shoulder portion and a fusion nib portion, said fusion nib extending outwardly from said shoulder.

10. The method of claim 9 wherein said finger element is formed in the shape of a dart having a body portion and a pointed head portion.

* * * * *